US005833052A

United States Patent [19]

Diamond

[11] Patent Number: 5,833,052

[45] Date of Patent: Nov. 10, 1998

[54] JEWELRY CHAIN HOLDING DEVICE

[76] Inventor: Patricia Mary Diamond, 507 Timber Oaks Rd., Edison, N.J. 08820

[21] Appl. No.: 918,888

[22] Filed: Aug. 7, 1997

[51] Int. Cl.[6] ..... B65D 83/04

[52] U.S. Cl. ..... 206/6.1; 220/533

[58] Field of Search ..... 206/6.1, 348, 566; 220/529, 532, 533, 552, 553

[56] References Cited

U.S. PATENT DOCUMENTS

| | | | |
|---|---|---|---|
| 2,459,940 | 1/1949 | Himmel | 220/529 |
| 2,714,443 | 8/1955 | Kuvin | 220/532 |
| 3,304,142 | 2/1967 | Rockola | 220/532 |
| 3,554,429 | 1/1971 | Cohen | 206/73 |
| 3,689,051 | 9/1972 | Miller | 220/529 |
| 4,264,013 | 4/1981 | Vollmer | 211/13 |
| 4,396,121 | 8/1983 | Lemmon | 206/6.1 |
| 4,811,996 | 3/1989 | Hansson | 206/566 |
| 4,974,746 | 12/1990 | Dickinson | 220/533 |
| 5,038,927 | 8/1991 | Bell | 206/45.14 |
| 5,117,971 | 6/1992 | Fisher | 206/6.1 |

*Primary Examiner*—Paul T. Sewell
*Assistant Examiner*—Nhan T. Lam

[57] ABSTRACT

A jewelry chain holding device including a container. A jewelry chain holder insert is dimensioned for slidably coupling within the container. The jewelry chain holder insert is adapted for receiving a jewelry chain in a folded orientation therein.

6 Claims, 2 Drawing Sheets

JEWELRY CHAIN HOLDING DEVICE

BACKGROUND OF THE INVENTION

1. Field of the Invention

The present invention relates to a jewelry chain holding device and more particularly pertains to precluding jewelry chains from becoming tangled and knotted when not being worn.

2. Description of the Prior Art

The use of jewelry containers is known in the prior art. More specifically, jewelry containers heretofore devised and utilized-for the purpose of displaying jewelry articles are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,425,444 to Chapman discloses a necklace holder for storage and display. U.S. Pat. No. 4,552,264 to Quarrell et al. discloses a jewelry container. U.S. Pat. No. Des. 248,801 to Tafoya discloses the ornamental design for a combined earring and jewelry holder. U.S. Pat. No. 5,121,833 to Lindsay et al. discloses a jewelry display and travel device. U.S. Pat. No. 4,390,099 to Trautlein et al. discloses a display stand for jewelry articles. U.S. Pat. No. 4,264,013 to Vollmer discloses a jewelry holder.

While these devices fulfill their respective, particular objective and requirements, the aforementioned patents do not describe a jewelry chain holding device for precluding jewelry chains from becoming tangled and knotted when not being worn.

In this respect, the jewelry chain holding device according to the present invention substantially departs from the conventional concepts and designs of the prior art, and in doing so provides an apparatus primarily developed for the purpose of precluding jewelry chains from becoming tangled and knotted when not being worn.

Therefore, it can be appreciated that there exists a continuing need for new and improved jewelry chain holding device which can be used for precluding jewelry chains from becoming tangled and knotted when not being worn. In this regard, the present invention substantially fulfills this need.

SUMMARY OF THE INVENTION

In the view of the foregoing disadvantages inherent in the known types of jewelry containers now present in the prior art, the present invention provides an improved jewelry chain holding device. As such, the general purpose of the present invention, which will be described subsequently in greater detail, is to provide a new and improved jewelry chain holding device and method which has all the advantages of the prior art and none of the disadvantages.

To attain this, the present invention essentially comprises a container having a generally elongated and rectangular configuration. The container has an open upper end, an open lower end and opposing side walls. The container has a pair of opposed longitudinal grooves formed interiorly on two of the opposing side walls. The grooves begin at the open upper end and extend downwardly to a stop point disposed above the open lower end. A jewelry chain holder insert is dimensioned for slidably coupling within the container. The jewelry chain holder insert comprises an inverted generally U-shaped handle. The handle has a short horizontal segment and a pair of elongated vertical segments extending downwardly from opposed ends of the short horizontal segment. The vertical segments are slidably received within the pair of grooves of the container. The jewelry chain holder insert further comprises a generally t-shaped cross bar secured between the vertical segments of the handle. The t-shaped cross bar has engaging teeth formed in an upper surface thereof. The engaging teeth are adapted for receiving jewelry chain in a folded orientation therein.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved jewelry chain holding device which has all the advantages of the prior art jewelry containers and none of the disadvantages.

It is another object of the present invention to provide a new and improved jewelry chain holding device which may be easily and efficiently manufactured and marketed.

It is a further object of the present invention to provide a new and improved jewelry chain holding device which is of durable and reliable construction.

An even further object of the present invention is to provide a new and improved jewelry chain holding device which is susceptible of a low cost of manufacture with regard to both materials and labor, and which accordingly is then susceptible of low prices of sale to the consuming public, thereby making such a jewelry chain holding device economically available to the buying public.

Even still another object of the present invention is to provide a new and improved jewelry chain holding device for precluding jewelry chains from becoming tangled and knotted when not being worn.

Lastly, it is an object of the present invention to provide a new and improved jewelry chain holding device including a container. A jewelry chain holder insert is dimensioned for slidably coupling within the container. The jewelry chain holder insert is adapted for receiving a jewelry chain in a folded orientation therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
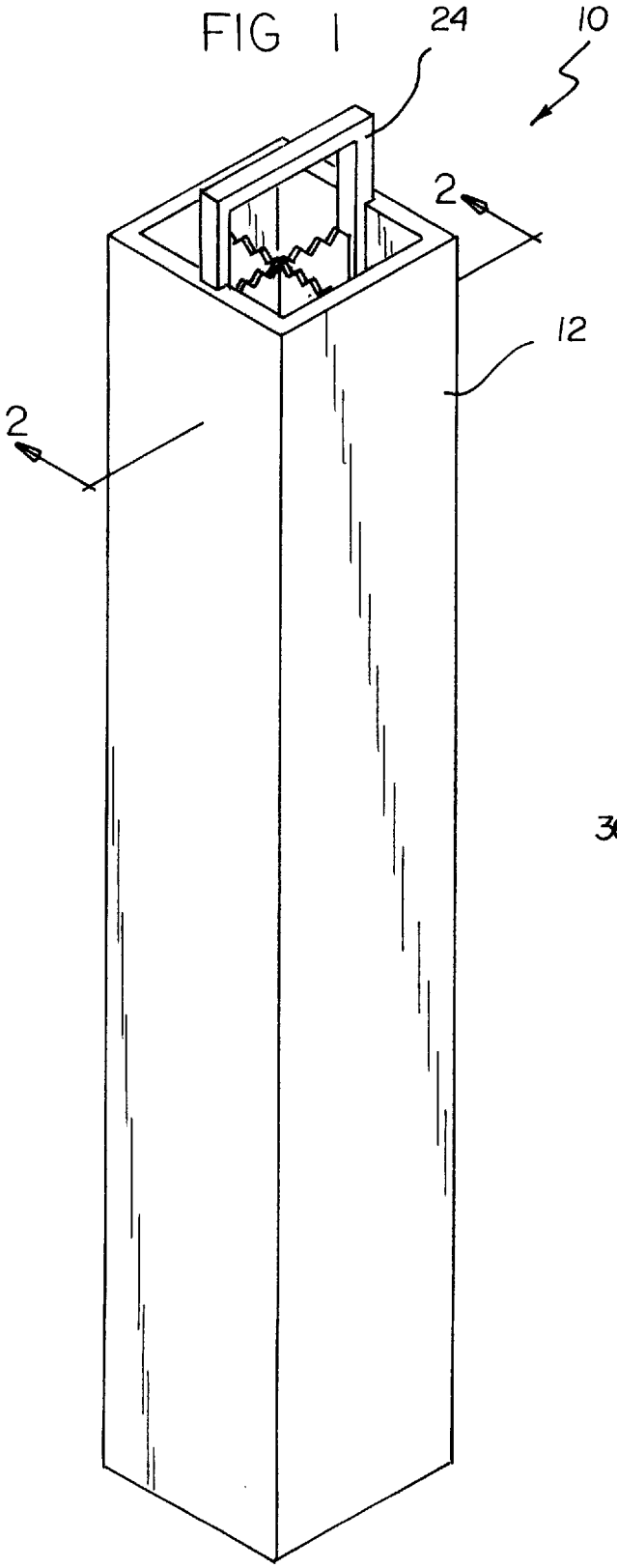
FIG. 1 is a perspective view of the preferred embodiment of the jewelry chain holding device constructed in accordance with the principles of the present invention.
Figure 2:
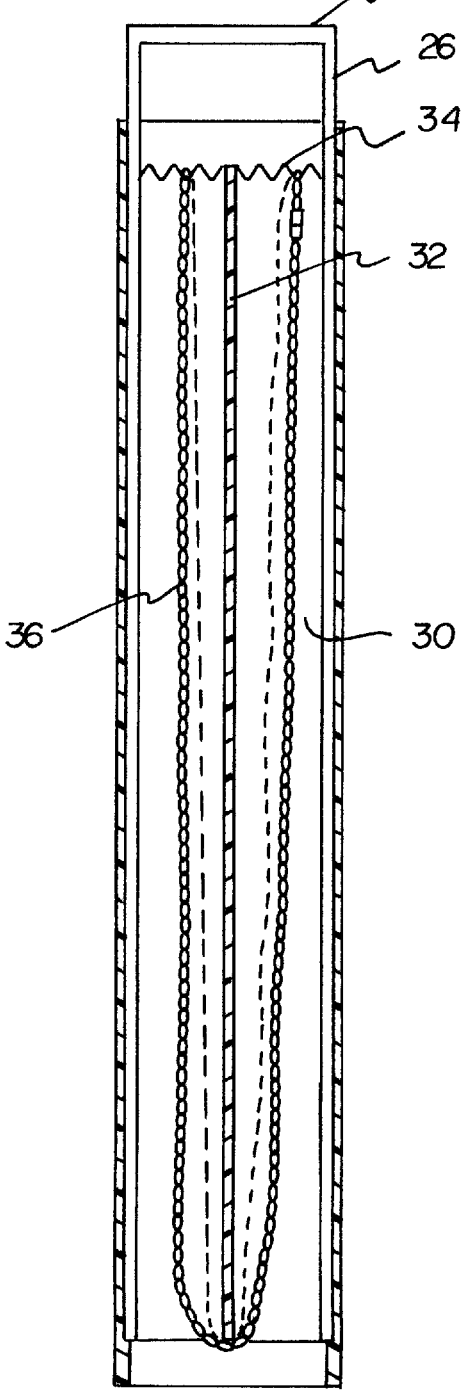
FIG. 2 is a cross-sectional view as taken along line 2—2 of FIG. 1.
Figure 3:
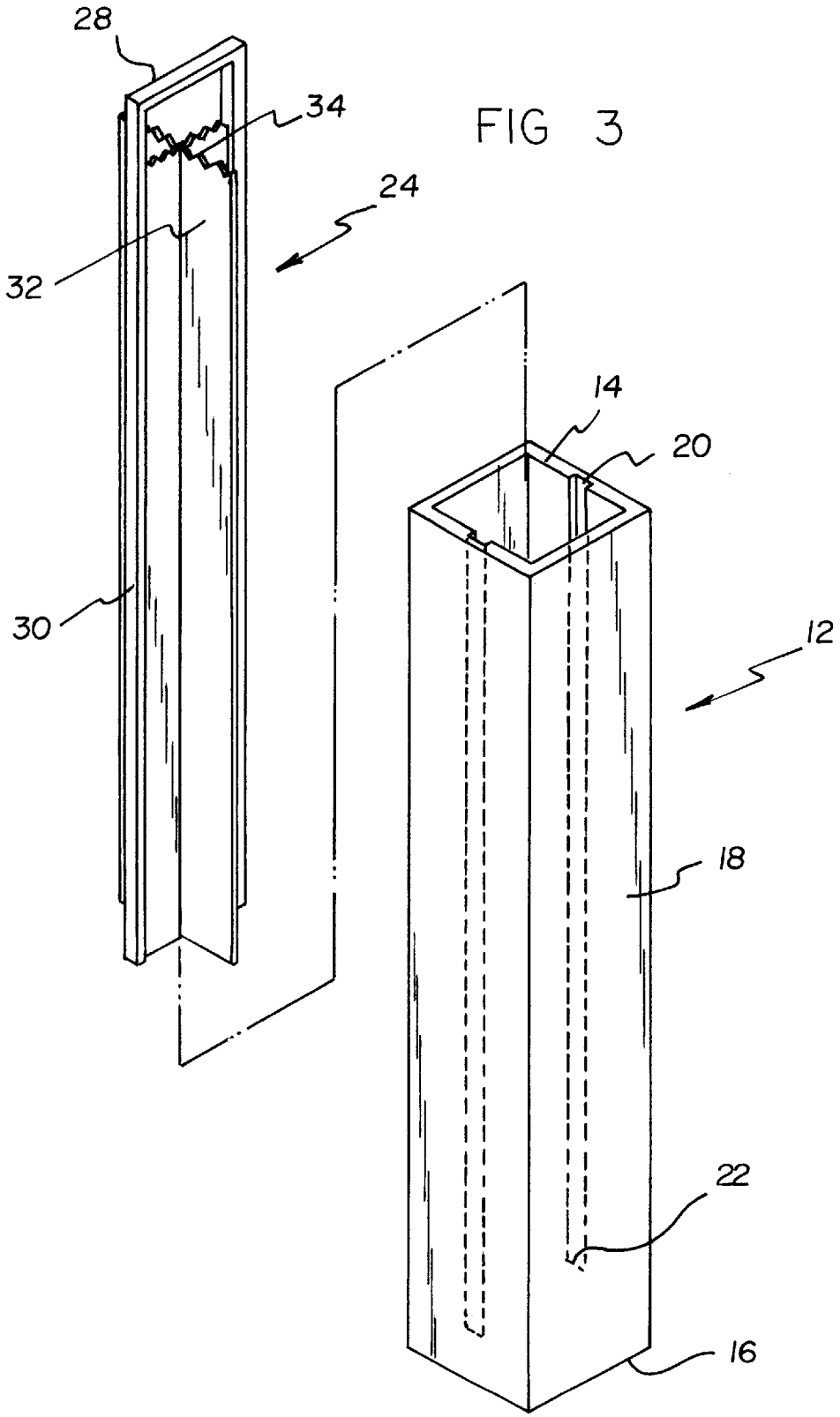
FIG. 3 is an exploded perspective view of the present invention.

With reference now to the drawings, and in particular, to FIGS. 1 through 3 thereof, the preferred embodiment of the new and improved jewelry chain holding device embodying the principles and concepts of the present invention and generally designated by the reference number 10 will be described.

Specifically, it will be noted in the various Figures that the device relates to a jewelry chain holding device for precluding jewelry chains from becoming tangled and knotted when not being worn. In its broadest context, the device consists of a container and a jewelry chain holder insert. Such components are individually configured and correlated with respect to each other so as to attain the desired objective.

The device 10 includes a container 12 having a generally elongated and rectangular configuration. The container is a free standing structure. The preferable construction of the container is a rigid plastic, preferably having a high luster, such as Lucite or the like. The container has an open upper end 14, an open lower end 16 and opposing side walls 18. The side walls are of equal dimensions. The length of the side walls can be varied to accommodate various lengths of jewelry chains. The container has a pair of opposed longitudinal grooves 20 formed interiorly on two of the opposing side walls. The grooves begin at the open upper end and extend downwardly to a stop point 22 disposed above the open lower end.

A jewelry chain holder insert 24 is dimensioned for slidably coupling within the container. The jewelry chain holder insert comprises an inverted generally U-shaped handle 26. The handle has a short horizontal segment 28 and a pair of elongated vertical segments 30 extending downwardly from opposed ends of the short horizontal segment. The vertical segments are slidably received within the pair of grooves of the container. Free ends of the vertical segments will abut the stop point of the grooves so that the insert will not slide out of the container. The horizontal segment provides a means for gripping and manipulating the insert with respect to the container. The jewelry chain holder insert further comprises a generally t-shaped cross bar 32 secured between the vertical segments of the handle. The t-shaped cross bar has engaging teeth 34 formed in an upper surface thereof. The engaging teeth are adapted for receiving a jewelry chain 36 in a folded orientation therein. When a jewelry chain is not in use, a person folds the chain in half and then drapes the chain over the insert and inverts the holder and drapes the folded chain again over the insert. The chain is then secured over the teeth at the upper surface of the insert while a lower portion of the chain is engaged around the lower surface of the insert. The insert is then ready to slide within the container for protection of the jewelry chain from becoming tangled or broken.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A jewelry chain holding device for precluding jewelry chains from becoming tangled and knotted when not being worn comprising, in combination:

a container having a elongated and rectangular configuration, the container having an open upper end, an open lower end and opposing side walls, the container having a pair of opposed longitudinal grooves formed interiorly on two of the opposing side walls, the grooves beginning at the open upper end and extending downwardly to a stop point disposed above the open lower end; and a jewelry chain holder insert dimensioned for slidably coupling within the container, the jewelry chain holder insert comprising an inverted U-shaped handle, the handle having a short horizontal segment and a pair of elongated vertical segments extending downwardly from opposed ends of the short horizontal segment, the vertical segments slidably received within the pair of grooves of the container, the jewelry chain holder insert further comprising a t-shaped cross bar secured between the vertical segments of the handle, the t-shaped cross bar having engaging teeth formed in an upper surface thereof, the engaging teeth adapted for receiving a jewelry chain in a folded orientation therein.

2. A jewelry chain holding device comprising:

a container; and a jewelry chain holder insert dimensioned for slidably coupling within the container, the jewelry chain holder insert adapted for receiving jewelry chains in a folded orientation therein;

wherein the jewelry chain holder insert comprises an inverted U-shaped handle, the handle having a short horizontal segment and a pair of elongated vertical segments extending downwardly from opposed ends of the short horizontal segment, the vertical segments slidably received within a pair of grooves in the container.

3. The device as set forth in claim 2 wherein the container has a generally elongated and rectangular configuration, the container having an open upper end, an open lower end and opposing side walls.

4. The device as set forth in claim 3 wherein the container has a pair of opposed longitudinal grooves formed interiorly on two of the opposing side walls, the grooves beginning at the open upper end and extending downwardly to a stop point disposed above the open lower end for receiving the jewelry chain holder insert.

5. The device as set forth in claim 2 wherein the jewelry chain holder insert further comprises a t-shaped cross bar secured between the vertical segments of the handle.

6. The device as set forth in claim 3 wherein the t-shaped cross bar has engaging teeth formed in an upper surface thereof, the engaging teeth adapted for receiving the jewelry chain in a folded orientation therein.

* * * * *